US011691065B1

(12) United States Patent
Llano

(10) Patent No.: US 11,691,065 B1
(45) Date of Patent: Jul. 4, 2023

(54) TENNIS PRACTICE APPARATUS

(71) Applicant: Mario Llano, Newport, RI (US)

(72) Inventor: Mario Llano, Newport, RI (US)

( * ) Notice: Subject to any disclaimer, the term of this patent is extended or adjusted under 35 U.S.C. 154(b) by 51 days.

(21) Appl. No.: 17/405,512

(22) Filed: Aug. 18, 2021

(51) Int. Cl.
*A63B 69/38* (2006.01)
*A63B 63/00* (2006.01)

(52) U.S. Cl.
CPC ..... *A63B 69/38* (2013.01); *A63B 63/00* (2013.01); *A63B 2063/001* (2013.01); *A63B 2210/50* (2013.01); *A63B 2214/00* (2020.08)

(58) Field of Classification Search
CPC ..... A63B 69/38; A63B 63/00; A63B 2214/00; A63B 2210/50; A63B 2063/001
See application file for complete search history.

(56) References Cited

U.S. PATENT DOCUMENTS

| | | | | | |
|---|---|---|---|---|---|
| 3,847,132 | A | | 11/1974 | Schatz | |
| 3,989,246 | A | | 11/1976 | Brown et al. | |
| 4,239,235 | A | * | 12/1980 | Torres | A63B 69/0097 473/434 |
| 4,886,268 | A | | 12/1989 | Langslet | |
| 4,993,709 | A | | 2/1991 | Tominaga | |
| 6,357,750 | B1 | | 3/2002 | Lievens | |
| 8,177,271 | B2 | | 5/2012 | Zats | |
| 9,155,952 | B2 | | 10/2015 | Yamanashi | |
| 2016/0175682 | A1 | * | 6/2016 | Patton | A63B 69/0097 473/431 |

FOREIGN PATENT DOCUMENTS

| | | | | | |
|---|---|---|---|---|---|
| BE | 881722 | A | * | 5/1980 | A63B 63/00 |
| CN | 106943732 | A | * | 7/2017 | A63B 47/025 |
| CN | 206853047 | U | * | 1/2018 | |
| CN | 207591251 | U | * | 7/2018 | |
| CN | 111111140 | A | * | 5/2020 | A63B 63/00 |
| CN | 111150986 | A | * | 5/2020 | A63B 69/38 |
| CN | 112843653 | A | * | 5/2021 | A63B 69/38 |
| CN | 215025872 | U | * | 12/2021 | |
| CN | 114699755 | A | * | 7/2022 | |
| CN | 217612806 | U | * | 10/2022 | |
| DE | 202021003990 | U1 | * | 6/2022 | |
| EP | 220111 | A | * | 4/1987 | A63B 63/00 |
| JP | 2010125071 | A | * | 6/2010 | |
| KR | 100860881 | B1 | * | 9/2008 | A63B 69/38 |
| KR | 20100054967 | A | * | 5/2010 | A63B 69/38 |
| KR | 101812146 | B1 | * | 12/2017 | A63B 47/025 |
| KR | 101812143 | B1 | * | 1/2018 | A63B 63/00 |
| KR | 2019044266 | A | * | 4/2019 | A63B 24/0062 |
| WO | WO-2011070662 | A1 | * | 6/2011 | A63B 63/00 |
| WO | WO-2017070694 | A1 | * | 4/2017 | A63B 63/00 |

OTHER PUBLICATIONS https://www.dksportbot.com/518-tennis-training-net-tennis-rebounding-net-device-simple-useful-tennis-training-equipment.html.

* cited by examiner

*Primary Examiner* — Raleigh W Chiu
(74) *Attorney, Agent, or Firm* — Salter & Michaelson

(57) ABSTRACT

A tennis practice apparatus that includes a main support member that is for mounting from an upright wall; an outer support member that is hinged with the main support member and includes a closed position wherein the outer support member is engaged against the main support member, and an open position wherein the outer support member is hinged to an open position that is substantially orthogonal to the main support member; and a pliable fabric sheet that extends between a top end of the main support member and the outer support member. The pliable fabric sheet defines a surface against which a user can hit tennis balls and retrieve tennis balls therefrom.

11 Claims, 9 Drawing Sheets

TENNIS PRACTICE APPARATUS

FIELD OF THE INVENTION

The present invention relates in general to a tennis practice apparatus and pertains, more particularly, to an improved tennis practice apparatus that is simple in construction, compact and economical.

BACKGROUND OF THE INVENTION

There presently exists tennis practice systems such as the one described in U.S. Pat. No. 3,989,246 to Brown et al. The problem with most tennis practice systems is that they are far to complex and costly to install.

Accordingly, it is an object of the present invention to provide a simplified tennis practice apparatus that is readily mounted to a wall structure and that can assume open and closed positions.

Another object of the present invention is to provide an improved tennis practice apparatus and device that is relatively compact in construction, that is relatively simple in construction, and that can be manufactured relatively economically.

SUMMARY OF THE INVENTION

In accordance with the present invention there is provided a tennis practice apparatus that is comprised of a main support member that is for mounting from an upright wall; an outer support member that is hinged with the main support member and includes a closed position wherein the outer support member is engaged against the main support member, and an open position wherein the outer support member is hinged to an open position that is substantially orthogonal to the main support member; and a pliable fabric sheet that extends between a top end of the main support member and the outer support member; the pliable fabric sheet defining a surface against which a user can hit tennis balls and retrieve tennis balls therefrom.

In accordance with other aspects of the present invention the main support member is a planar first support plate member; the outer support member is a planar second support plate member; the outer support member is hinged to the main support member by means of one or more mechanical hinges that are disposed between bottom ends of the respective main and outer support members; the one or more hinges maintain the support members in the substantially orthogonal relative position while maintaining the pliable fabric sheet not taut but instead partially looped to provide an absorbent surface for the tennis balls; the outer support member is hinged to the main support member by means of contact of the pliable fabric sheet being secured between a top end of the respective main and outer support members; including a ball stopper disposed adjacent to a top end of the pliable fabric sheet and for redirecting tennis balls downwardly along the pliable fabric sheet; including a protruding bump at a top end of the outer support member so that, when a tennis ball is hit against the pliable fabric sheet and falls downwardly therealong, the tennis ball is redirected toward the user; wherein the ball stopper is foldable from a concealed position to a position that enables contact with and redirects the tennis balls downwardly along the pliable fabric sheet; and wherein the bump is formed in an upwardly facing surface of the second planar outer support member in the open position of the second planar outer support member, and outside of the pliable fabric sheet so that tennis balls that fall downwardly along the pliable fabric sheet are redirected toward the player.

In accordance with the present invention there is also provided a tennis practice device that is comprised of a first planar support member that is for mounting to an upright wall; a second planar outer support member that is hinged with the first planar support member and includes a closed position wherein the second planar outer support member is engaged against the first planar support member, and an open position wherein the second planar outer support member is hinged to an open position that is substantially orthogonal to the first planar support member; and a pliable fabric sheet that extends between a top end of the first planar support member and a top end the outer support member; the pliable fabric sheet defining a surface against which a user can hit tennis balls and retrieve tennis balls therefrom.

In accordance with still other aspects of the present invention the second planar outer support member is hinged to the first planar support member by means of one or more mechanical hinges that are disposed between bottom ends of the respective first and second planar support members; the second planar support member is hinged to the first planar support member by means of contact of the pliable fabric sheet being secured between a top end of the respective first and second planar support members; including a ball stopper disposed adjacent to a top end of the pliable fabric sheet and for redirecting tennis balls downwardly along the pliable fabric sheet; including a protruding bump at a top end of the second planar outer support member so that, when a tennis ball is hit against the pliable fabric sheet and falls downwardly therealong, the tennis ball is redirected toward the user; and including a ball stopper disposed adjacent to a top end of the pliable fabric sheet and for redirecting tennis balls downwardly along the pliable fabric sheet; a protruding bump at a top end of the outer support member so that, when a tennis ball is hit against the pliable fabric sheet and falls downwardly therealong, the tennis ball is redirected toward the player; wherein the ball stopper is foldable from a concealed position to a position that enables contact with and redirects the tennis balls downwardly along the pliable fabric sheet; and wherein the bump is formed in an upwardly facing surface of the second planar outer support member in the open position of the second planar outer support member, and outside of the pliable fabric sheet so that tennis balls that fall downwardly along the pliable fabric sheet are redirected toward the player.

In accordance with the present invention there is further provided a method of practicing the striking of a tennis ball by directing the tennis ball toward a rebound structure which, in turn, redirects the tennis ball back toward a player, said rebound structure including a main support member that is for mounting from an upright wall; an outer support member that is hinged with the main support member and includes a closed position wherein the outer support member is engaged against the main support member, and an open position wherein the outer support member is hinged to an open position that is substantially orthogonal to the main support member; providing a pliable fabric sheet that extends between a top end of the main support member and the outer support member; the pliable fabric sheet defining a surface against which a user can hit tennis balls and retrieve tennis balls therefrom.

In accordance with still other aspects of the present invention including providing a ball stopper disposed adjacent to a top end of the pliable fabric sheet and for redirecting tennis balls downwardly along the pliable fabric sheet; including providing a protruding bump at a top end of the outer support member so that, when a tennis ball is hit against the pliable fabric sheet and falls downwardly therealong, the tennis ball is redirected toward the user; and wherein the ball stopper is foldable from a concealed position to a position that enables contact with and redirects the tennis balls downwardly along the pliable fabric sheet; and wherein the bump is formed in an upwardly facing surface of the second planar outer support member in the open position of the second planar outer support member, and outside of the pliable fabric sheet so that tennis balls that fall downwardly along the pliable fabric sheet are redirected toward the player.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
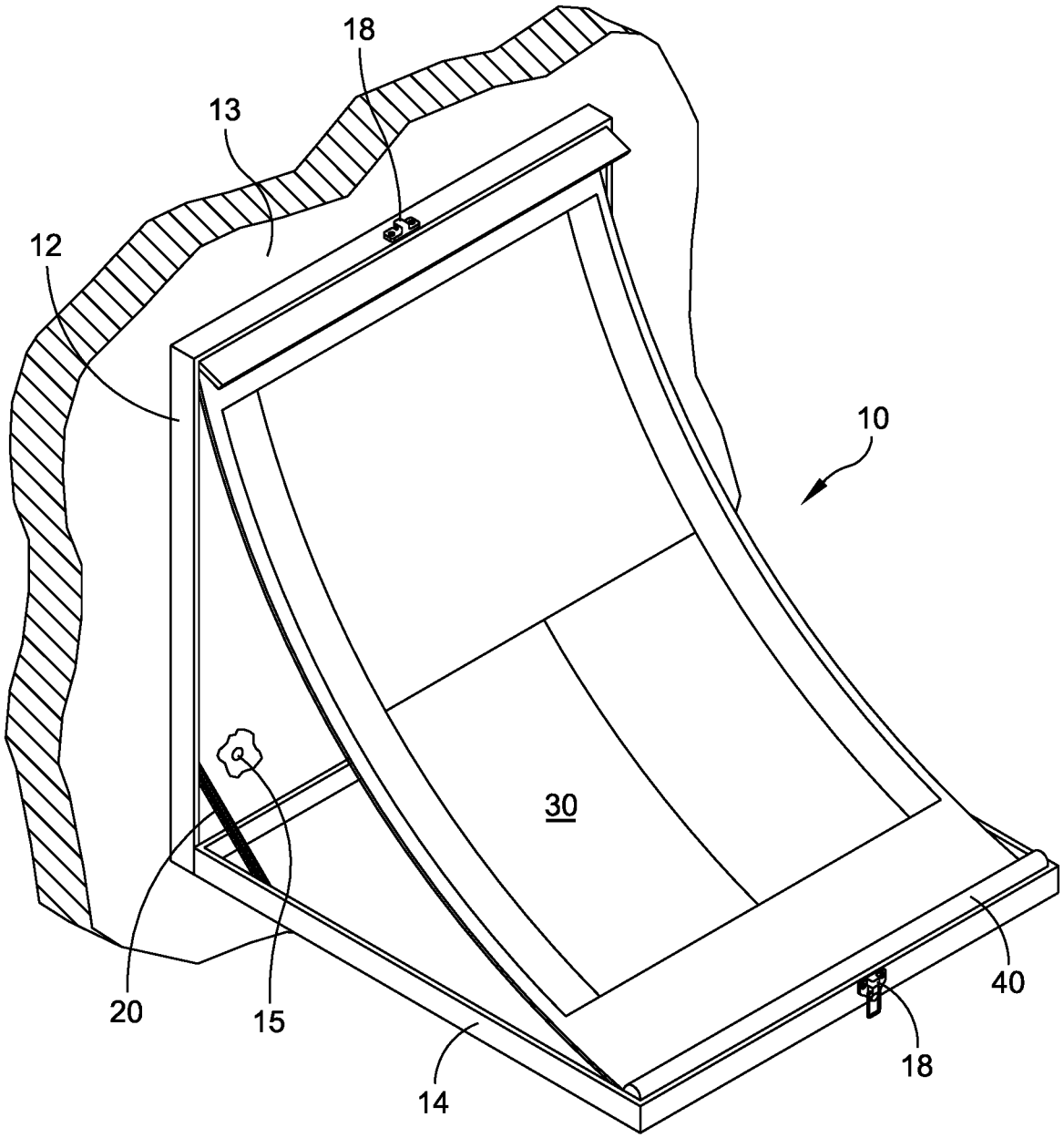
FIG. 1 is a perspective view showing the tennis practice apparatus of the present invention in an open position.
Figure 3:
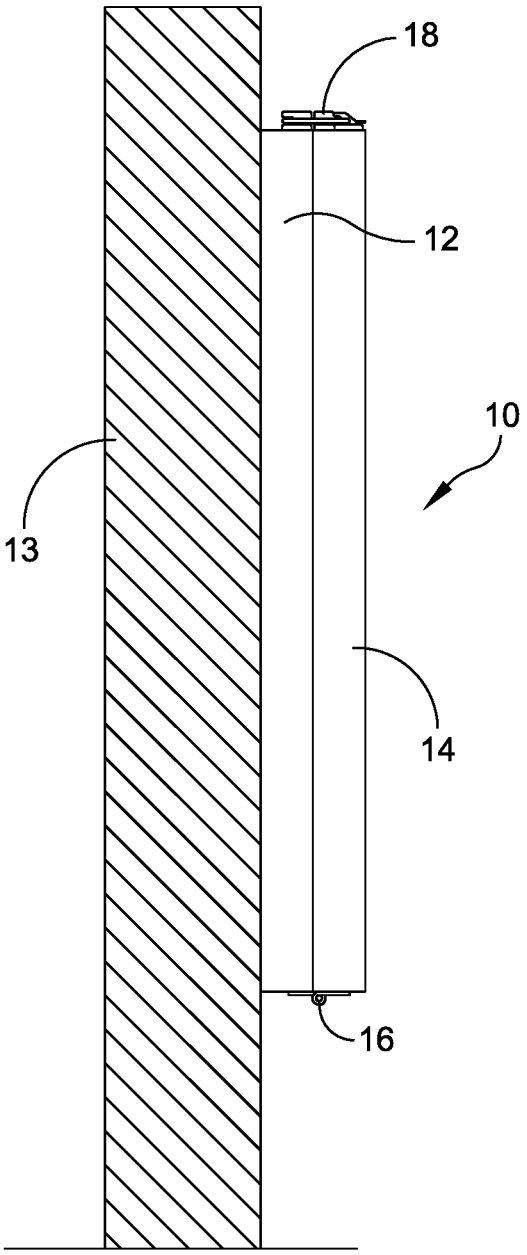
FIG. 3 is a side elevation view of the tennis practice apparatus illustrated in FIGS. 1 and 2.
Figure 6:
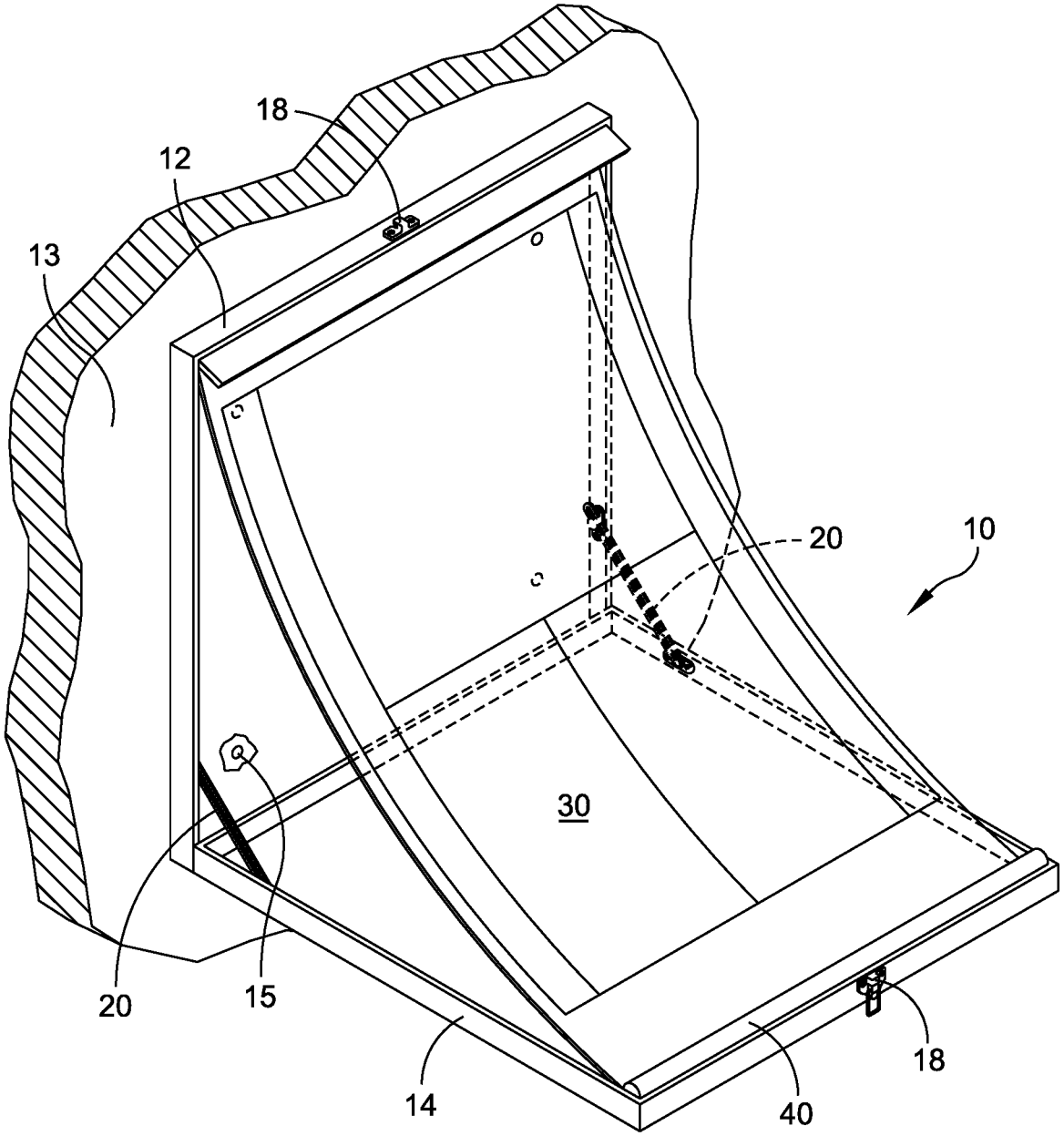
FIG. 6 is a perspective view similar to that illustrated in FIG. 1.
Figure 7:
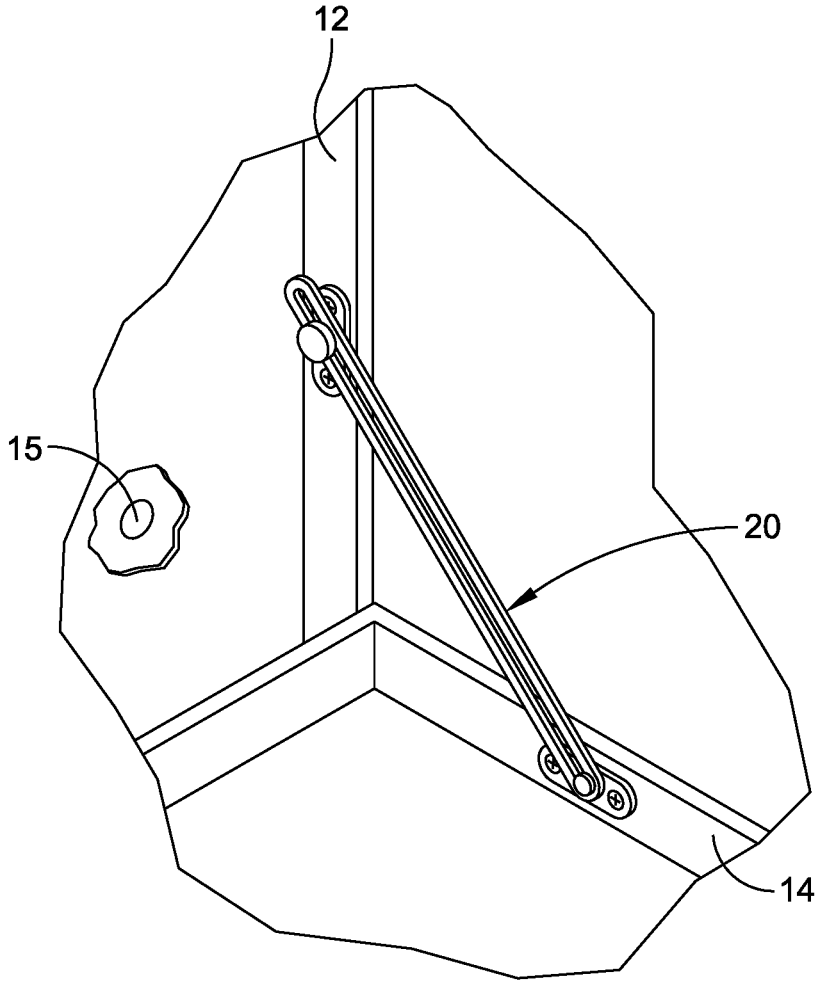
FIG. 7 is a fragmentary perspective view of a stop member.

Reference is now made to the drawings for an illustration of a preferred embodiment of the tennis practice apparatus of the present invention illustrated at 10. This apparatus is comprised of a main support member 12 that is for mounting from an upright wall 13 shown in a fragmentary section in FIG. 1. Refer also to the wall at 13 in FIG. 3 shown in cross-section. The main support member 20 may be constructed of a variety of different materials and is preferably constructed of a plastic material. The main support member 12 is of a planar construction and may be attached to the upright wall 13 by means of a plurality of fasteners one of which is illustrated at 15 in FIGS. 1, 6 and 7.

Figure 2:
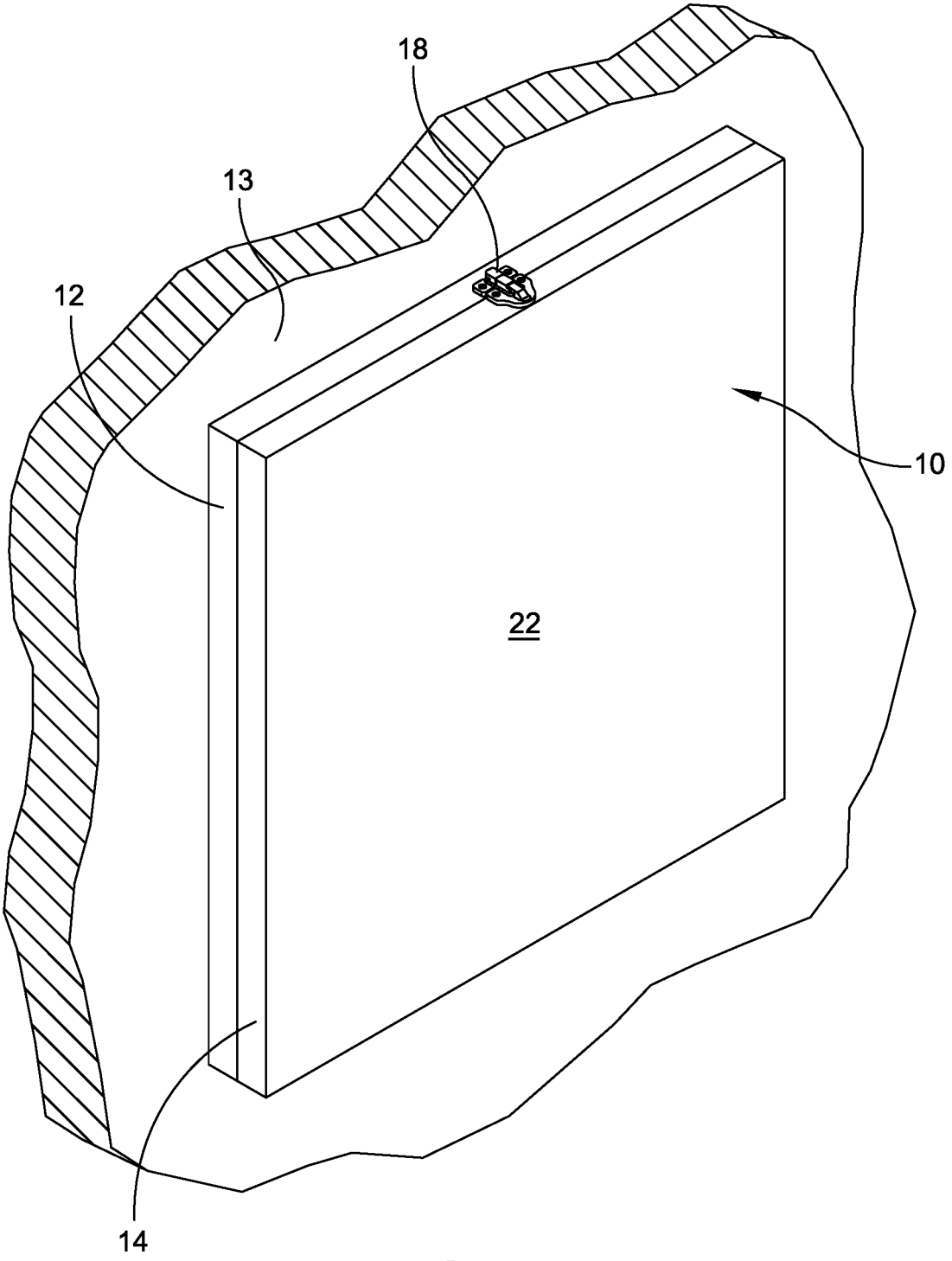
FIG. 2 is a perspective view showing the tennis practice apparatus in a closed position.
Figure 4:
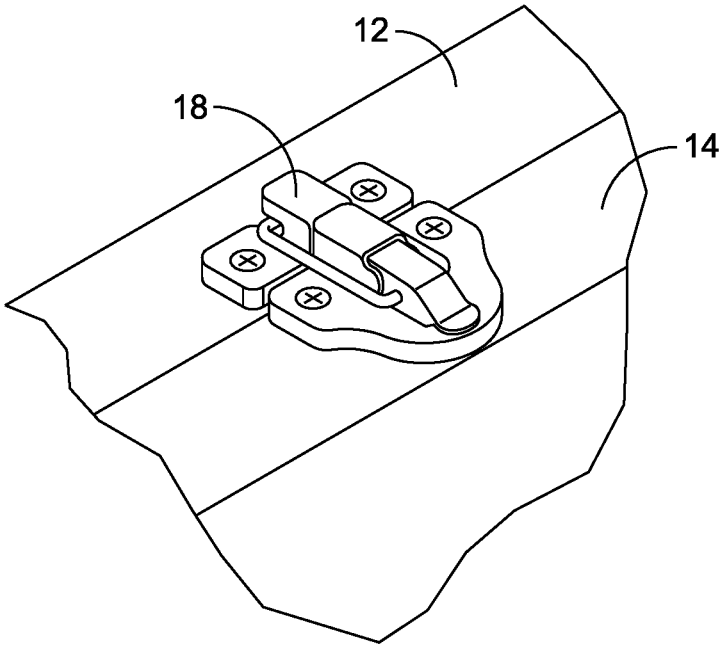
FIG. 4 is a fragmentary perspective illustration of a locking member.
Figure 5:
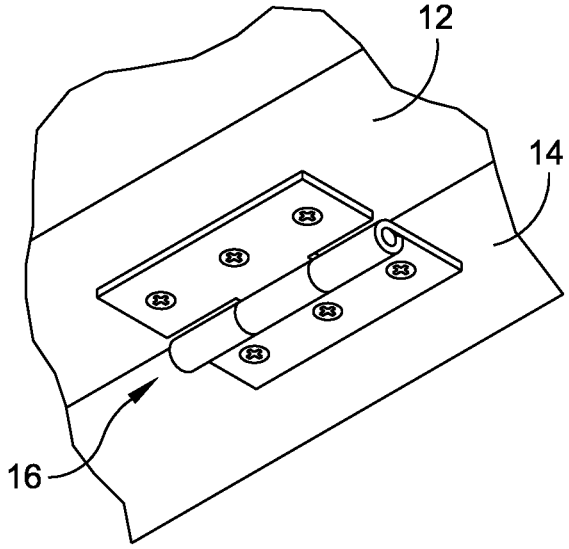
FIG. 5 is a fragmentary perspective view of a hinge member.

The tennis practice apparatus is also comprised of an outer support member 14 that is hinged with the main support member 12. A single or a plurality of hinges 16 may be employed such as illustrated in FIG. 5. The outer support member 14 has a closed position as illustrated in FIG. 2 wherein the outer support member 14 is engaged against the main support member 12. Both members 10 and 12 may be constructed in a similar configuration. In the closed position illustrated in FIG. 2, a lock 18 may be employed for maintaining this closed position. Refer also to the fragmentary perspective view of FIG. 4 for an illustration of a lock mechanism at 18.

Figure 8A:
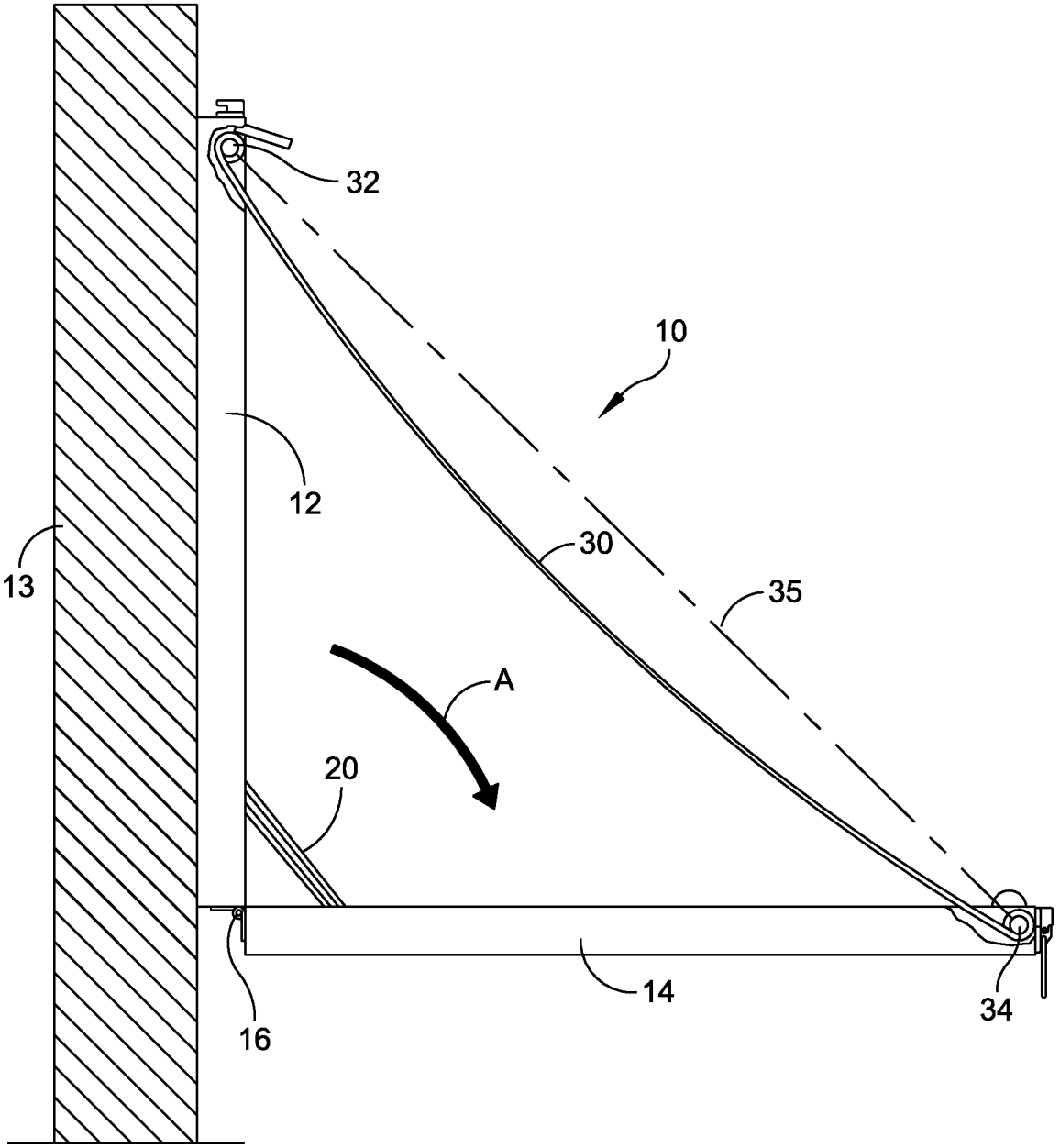
FIG. 8A is a side elevation view of the tennis practice apparatus in an open position and, in particular, illustrating the manner in which the pliable fabric sheet is secured.

As indicated previously, the outer support member 14 has a closed position as illustrated in FIGS. 2 and 3 and an open position wherein the outer support member is hinged to an open position that is substantially orthogonal to the main support member 12. This orthogonal relationship is clearly illustrated in FIGS. 8 and 9. In order to maintain a substantially horizontal position of the outer support member 14, a pair of stops 20 are provided. One detail of a specific stop structure is illustrated in the fragmentary perspective view of FIG. 7. The stop 20 may be adjustable in position. When the tennis practice apparatus is moved to the open position, these stops maintain the outer support member in a substantially horizontal position such as illustrated in FIG. 9. When in the closed position as illustrated in FIGS. 2 and 3, the surface 22 may be provided with illustrations, sketches or other advertising or instructive layouts so as to illustrate the purpose of the tennis practice apparatus.

In the drawings the support members 12 and 14 are illustrated as being of a square shape. However, in a practical embodiment of the present invention the support members are preferably taller than they are wide. In one embodiment the width of each support member was 41 inches and its height was 70 inches.

The tennis practice apparatus of the present invention is also provided with a pliable fabric sheet 30 that extends between a top end of the main support member 12 and an outer end of the support member 14. In this regard, reference is made to FIG. 8A for an illustration of respective support posts 32, 34 that are used for securing the pliable fabric sheet in a somewhat looped position. This looped position is illustrated by the dotted line 35 shown in FIG. 8A. The pliable fabric sheet is preferably not in a taut position but is somewhat looped or curved inward as illustrated in FIG. 8A. In that way when a tennis ball is hit against the pliable fabric sheet, it tends to be absorbed by the sheet rather than being directly rebounded off of the sheet.

The tennis practice apparatus of the present invention is also provided with a ball stopper 60 disposed adjacent to the end 41 of the support member 14. In this regard, refer to the side elevation view of FIG. 8 which shows the ball stopper at 60. Refer also to the perspective view of FIG. 1 that shows the ball stopper 60 extending against the full width of the apparatus. Reference may also be made to the illustrative FIG. 9 which shows the player hitting the ball against the pliable fabric sheet 30. FIG. 9 illustrates in dotted outline a ball 50 that has slid downwardly along the fabric sheet and engages the bump 40 so as to propel it back toward the player. In this way, the ball is essentially returned to the player each time the player hits the ball against the pliable fabric sheet 30. The player is typically 4 to 8 feet away from the tennis practice apparatus.

In accordance with the present invention, there is also provided a protruding bump 60 at a top end of the main support member. In this way, when a tennis ball is hit against the pliable fabric sheet should it move upwardly, the ball will be redirected to a downward direction as illustrated by an arrow B in FIG. 9.

Figure 8B:
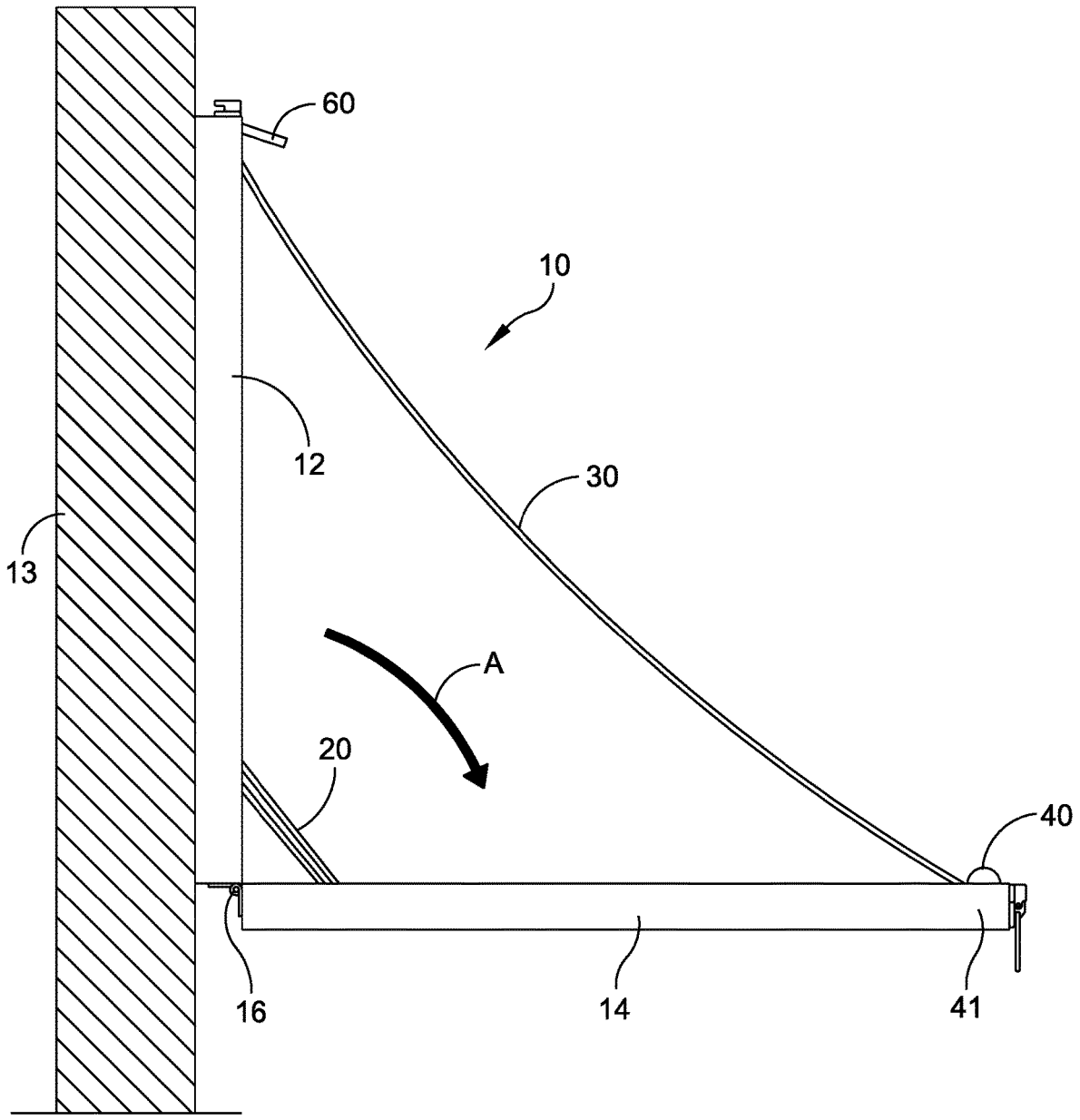
FIG. 8B is a side elevation view with the tennis practice apparatus in the open position and illustrating, at a top area, a foldable ball stopper; and at a lower area, a bump for redirecting the tennis ball.
Figure 9:
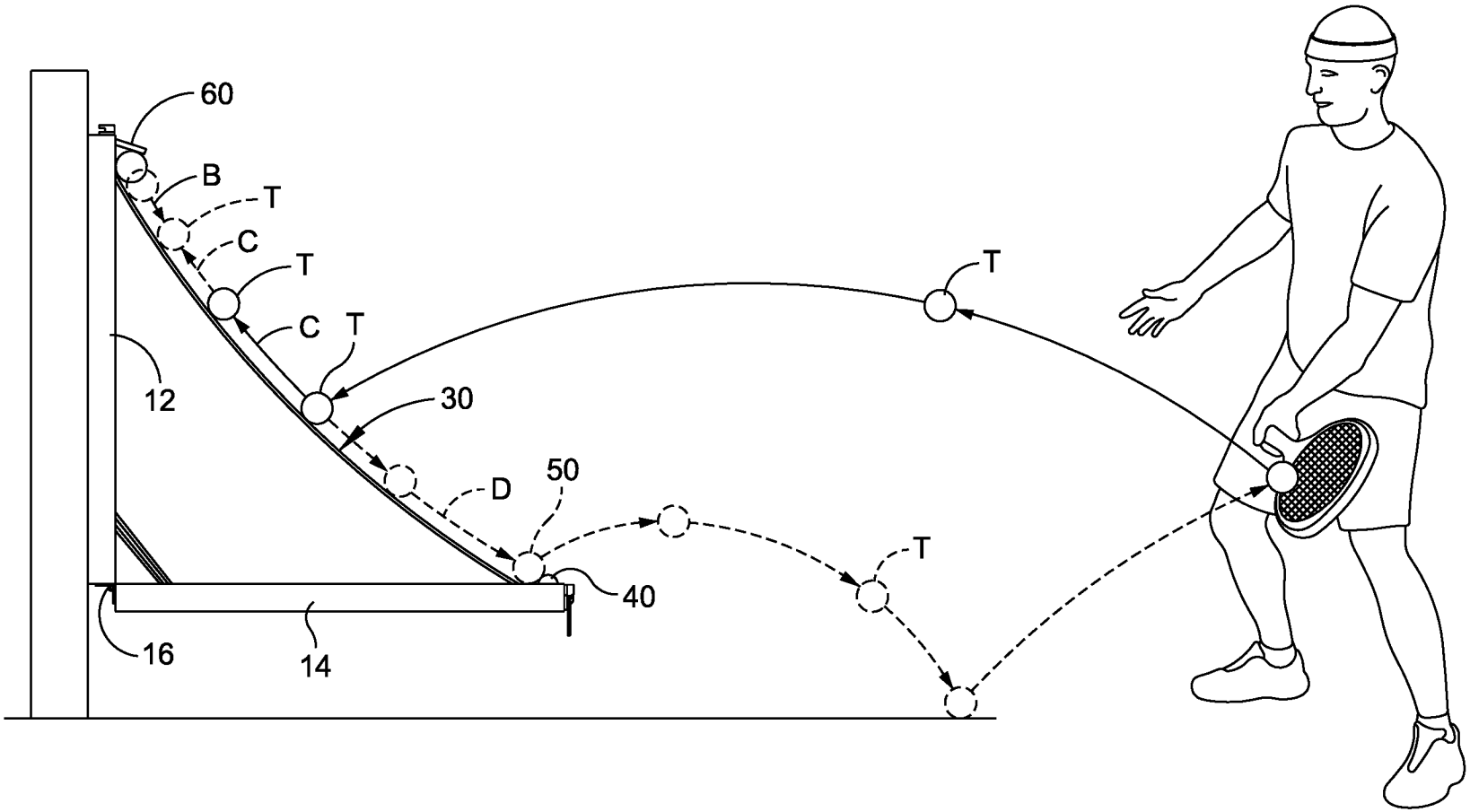
FIG. 9 is an illustration of the manner in which the player can use the tennis practice apparatus.

The ball stopper 60 is preferably foldable between a position such as illustrated in FIG. 8A where it is concealed to a position such as illustrated in FIG. 8B where it extends outwardly. The existence of the ball stopper 60, when a ball is hit against the pliable fabric sheet, to be redirected downwardly along the pliable fabric sheet where the ball may engage the bump 40 and be projected back to the player as illustrated in FIG. 9. Arrows C in FIG. 9 illustrate the possibility of the tennis ball T moving upwardly against the stopper 60. Arrows D show the progression of the tennis ball in a downward direction against the bump 40.

Thus, the bump 40 is formed in an upwardly facing surface of the planar support member 14 and is disposed in a manner, as illustrated in FIG. 9, so that it is potentially outside of the pliable fabric sheet 30 so that the tennis balls that fall downwardly along the pliable fabric sheet are redirected toward the player. FIG. 8B, in particular, shows the position of the bump 40 at the end of the support member 41 as well as illustrating the stopper 60 in its unfolded position so that it can engage any tennis balls that would tend to move upwardly on the pliable fabric sheet.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A tennis practice apparatus that is comprised of a main support member that is for mounting from an upright wall; an outer support member that is hinged with the main support member and includes a closed position wherein the outer support member is engaged against the main support member, and an open position wherein the outer support member is hinged to an open position that is substantially orthogonal to the main support member; and a pliable fabric sheet that extends between a top end of the main support member and the outer support member; the pliable fabric sheet defining a surface against which a user can hit tennis balls and retrieve tennis balls therefrom wherein the main support member is a planar first support plate member.

2. The tennis practice apparatus of claim 1 wherein the outer support member is a planar second support plate member.

3. The tennis practice apparatus of claim 1 wherein the outer support member is hinged to the main support member by means of one or more mechanical hinges that are disposed between bottom ends of the respective main and outer support members.

4. The tennis practice apparatus of claim 3 wherein the one or more hinges maintain the support members in the substantially orthogonal relative position while maintaining the pliable fabric sheet not taut but instead partially looped to provide an absorbent surface for the tennis balls.

5. The tennis practice apparatus of claim 1 including a ball stopper disposed adjacent to a top end of the pliable fabric sheet and for redirecting tennis balls downwardly along the pliable fabric sheet.

6. The tennis practice apparatus of claim 1 including a protruding bump at a top end of the outer support member so that, when a tennis ball is hit against the pliable fabric sheet and falls downwardly therealong, the tennis ball is redirected toward the user.

7. A tennis practice apparatus that is comprised of a main support member that is for mounting from an upright wall; an outer support member that is hinged with the main support member and includes a closed position wherein the outer support member is engaged against the main support member, and an open position wherein the outer support member is hinged to an open position that is substantially orthogonal to the main support member; and a pliable fabric sheet that extends between a top end of the main support member and the outer support member; the pliable fabric sheet defining a surface against which a user can hit tennis balls and retrieve tennis balls therefrom; including a ball stopper disposed adjacent to a top end of the pliable fabric sheet and for redirecting tennis balls downwardly along the pliable fabric sheet; and wherein the ball stopper is foldable from a concealed position to a position that enables contact with and redirects the tennis balls downwardly along the pliable fabric sheet.

8. The tennis practice apparatus of claim 7 including a protruding bump at a top end of the outer support member so that, when a tennis ball is hit against the pliable fabric sheet and falls downwardly therealong, the tennis ball is redirected toward the user; and wherein the protruding bump is formed in an upwardly facing surface of the outer support member in the open position of the outer support member, and outside of the pliable fabric sheet so that tennis balls that fall downwardly along the pliable fabric sheet are redirected toward a player.

9. A tennis practice device that is comprised of a first planar support member that is for mounting to an upright wall; a second planar outer support member that is hinged with the first planar support member and includes a closed position wherein the second planar outer support member is engaged against the first planar support member, and an open position wherein the second planar outer support member is hinged to an open position that is substantially orthogonal to the first planar support member; and a pliable fabric sheet that extends between a top end of the first planar support member and a top end the outer support member; the pliable fabric sheet defining a surface against which a user can hit tennis balls and retrieve tennis balls therefrom including a ball stopper disposed adjacent to a top end of the pliable fabric sheet and for redirecting tennis balls downwardly along the pliable fabric sheet; a protruding bump at a top end of the outer support member so that, when a tennis ball is hit against the pliable fabric sheet and falls downwardly therealong, the tennis ball is redirected toward a player; wherein the ball stopper is foldable from a concealed position to a position that enables contact with and redirects the tennis balls downwardly along the pliable fabric sheet; and wherein the bump is formed in an upwardly facing surface of the second planar outer support member in the open position of the second planar outer support member, and outside of the pliable fabric sheet so that tennis balls that fall downwardly along the pliable fabric sheet are redirected toward the player.

10. The tennis practice device of claim 9 wherein the second planar outer support member is hinged to the first planar support member by means of one or more mechanical hinges that are disposed between bottom ends of the respective first and second planar support members.

11. A method of practicing the striking of a tennis ball by directing the tennis ball toward a rebound structure which, in turn, redirects the tennis ball back toward a player, said rebound structure including a main support member that is for mounting from an upright wall; an outer support member that is hinged with the main support member and includes a closed position wherein the outer support member is engaged against the main support member, and an open position wherein the outer support member is hinged to an open position that is substantially orthogonal to the main support member; providing a pliable fabric sheet that extends between a top end of the main support member and the outer support member; the pliable fabric sheet defining a surface against which a user can hit tennis balls and retrieve tennis balls therefrom; providing a ball stopper disposed adjacent to a top end of the pliable fabric sheet and for redirecting tennis balls downwardly along the pliable fabric sheet; providing a protruding bump at a top end of the outer support member so that, when a tennis ball is hit against the pliable fabric sheet and falls downwardly therealong, the tennis ball is redirected toward the user; wherein the ball stopper is foldable from a concealed position to a position that enables contact with and redirects the tennis balls downwardly along the pliable fabric sheet; and wherein the bump is formed in an upwardly facing surface of the second planar outer support member in the open position of the second planar outer support member, and outside of the pliable fabric sheet so that tennis balls that fall downwardly along the pliable fabric sheet are redirected toward the player.

* * * * *